US010090608B2

(12) United States Patent
Lewis

(10) Patent No.: US 10,090,608 B2
(45) Date of Patent: Oct. 2, 2018

(54) ELECTRICAL CONNECTION SYSTEM HAVING A TERMINAL WITH CONTACT RIDGES

(71) Applicant: Delphi Technologies, Inc., Troy, MI (US)

(72) Inventor: Ryan D. Lewis, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 133 days.

(21) Appl. No.: 15/280,522

(22) Filed: Sep. 29, 2016

(65) Prior Publication Data

US 2018/0090854 A1 Mar. 29, 2018

(51) Int. Cl.

| | |
|---|---|
| ***H01R 11/22*** | (2006.01) |
| ***H01R 4/26*** | (2006.01) |
| ***H01R 13/187*** | (2006.01) |
| ***H01R 24/20*** | (2011.01) |
| ***H01R 24/28*** | (2011.01) |
| ***H01R 13/11*** | (2006.01) |
| *H01R 107/00* | (2006.01) |

(52) U.S. Cl.

CPC ..... *H01R 4/26* (2013.01); *H01R 13/113* (2013.01); *H01R 13/187* (2013.01); *H01R 24/20* (2013.01); *H01R 24/28* (2013.01); *H01R 2107/00* (2013.01)

(58) Field of Classification Search

CPC ..... H01R 13/11; H01R 13/6275; H01R 13/4223; H01R 13/113

USPC ..... 439/852, 595, 357, 752.5

See application file for complete search history.

(56) References Cited

U.S. PATENT DOCUMENTS

| | | | | |
|---|---|---|---|---|
| 6,506,084 | B2 * | 1/2003 | Saitoh | H01R 13/11 439/843 |
| 8,152,576 | B2 | 4/2012 | Nakamura et al. | |
| 8,333,622 | B2 * | 12/2012 | Blasko | H01R 13/113 439/595 |
| 9,118,130 | B1 | 8/2015 | Volpone et al. | |
| 2002/0055297 | A1 | 5/2002 | Feeny | |
| 2014/0287635 | A1 | 9/2014 | Tsuji et al. | |
| 2015/0180166 | A1 | 6/2015 | Wu et al. | |

FOREIGN PATENT DOCUMENTS

| | | | |
|---|---|---|---|
| EP | 1233475 | A2 | 8/2002 |
| JP | 2011239372 | A | 11/2011 |
| JP | 2015153553 | A | 8/2015 |

* cited by examiner

*Primary Examiner* — Phuong Chi T Nguyen

(74) *Attorney, Agent, or Firm* — Robert J. Myers

(57) ABSTRACT

An electrical connection system having a male terminal and female terminal configured to receive the male terminal. The female terminal has a resilient contact defining a ridge extending vertically from a top surface of the resilient contact and extends longitudinally along the resilient contact. The ridge is configured to provide a contact point between the female terminal and the male terminal. A leading edge of the ridge forms a ramp having an angle that is greater than 0 degrees and less than or equal to 30 degrees relative to the top surface of the resilient contact.

12 Claims, 3 Drawing Sheets

ELECTRICAL CONNECTION SYSTEM HAVING A TERMINAL WITH CONTACT RIDGES

TECHNICAL FIELD OF THE INVENTION

The invention generally relates to electrical connection system, and more particularly relates to an electrical connection system having an electrical terminal with contact ridges that are configured to provide a reduced terminal engagement force.

BACKGROUND OF THE INVENTION

In electrical connection systems using stamped terminals, the female stamped terminal may include a ribbed contact surface to provide a concentrated contact point for the male terminal. In some applications, this contact surface in the female terminal is embossed and abruptly rises into the path of the male terminal as the connection system is being mated as illustrated in FIG. 1.

The reoccurring customer complaint with connection systems is that the engagement force of the two mating connectors is too high. While there are a number of methods that can be used to reduce the engage force, some changes are more efficient than others. Some connectors have used different materials for their stamped terminals that has a lower coefficient of friction while others have used lubricants such as grease or oil.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

According to a first embodiment, an electrical connection system is presented, The electrical connection system includes a male terminal and a female terminal configured to receive the male terminal. The female terminal has a resilient contact defining a ridge or a plurality of ridges extending vertically from the contact and longitudinally along the contact. The resilient contact may be characterized as a cantilever beam. The ridge is configured to provide a contact point between the female terminal and the male terminal. The resilient contact may have an arcuate shape that defines an apex and the ridge extends over the apex. A leading edge of the ridge forms an angle with the resilient contact that is greater than 0 degrees and less than or equal to 30 degrees. The angle may preferably be about 10 degrees. The leading edge may be substantially linear. The ridge may be formed by embossing the contact.

According to a second embodiment, a female electrical socket terminal configured to receive a corresponding male plug terminal is presented. The female electrical socket terminal includes a resilient contact configured to contact the male plug terminal and a longitudinal protrusion projecting from a top surface of the contact. The resilient contact may be characterized as a cantilever beam. The resilient contact may have an arcuate shape that defines an apex and the longitudinal protrusion extends over the apex. The longitudinal protrusion is configured to provide a point contact between the contact and the male plug terminal. The longitudinal protrusion may be formed in the contact by an embossing process. The female electrical socket terminal further includes a ramp on a forward edge of the longitudinal protrusion. The ramp has a second top surface that forms an angle relative to the first top surface that is greater than 0 degrees and less than or equal to 30 degrees. The angle may preferably be about 10 degrees. The ramp may be substantially linear.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

Corresponding features of the various examples presented herein have reference numbers that differ by 100, e.g. 10, 110, 210.

DETAILED DESCRIPTION OF THE INVENTION

The inventor has observed that the engagement force when one terminal is inserted into another follows a pattern: as the male terminal is inserted into the female terminal, the force required to overcome the frictional forces and reaction forces from the female terminal increases to a peak value and then is reduced and stabilizes to a relatively constant engagement force until the male terminal is fully inserted within the female terminal. In order to reduce customer complaints of high engagement force, the peak engagement force should be reduced as much as possible.

The connection system presented herein reduces the peak engagement force by increasing the lead-in angle on the stamped ribs on the female terminal. In most cases, the contact ribs are embossed into the metal and when the male interface is inserted, it stubs against this raised material until the force applied is great enough to slide up and over the embossed material. The proposed invention is a graduated emboss wherein a lead-in angle is applied to the embossed material such that upon insertion, the mating male interface gradually encounters the contact ribs and requires less force to overcome the raised material.

Figure 1:
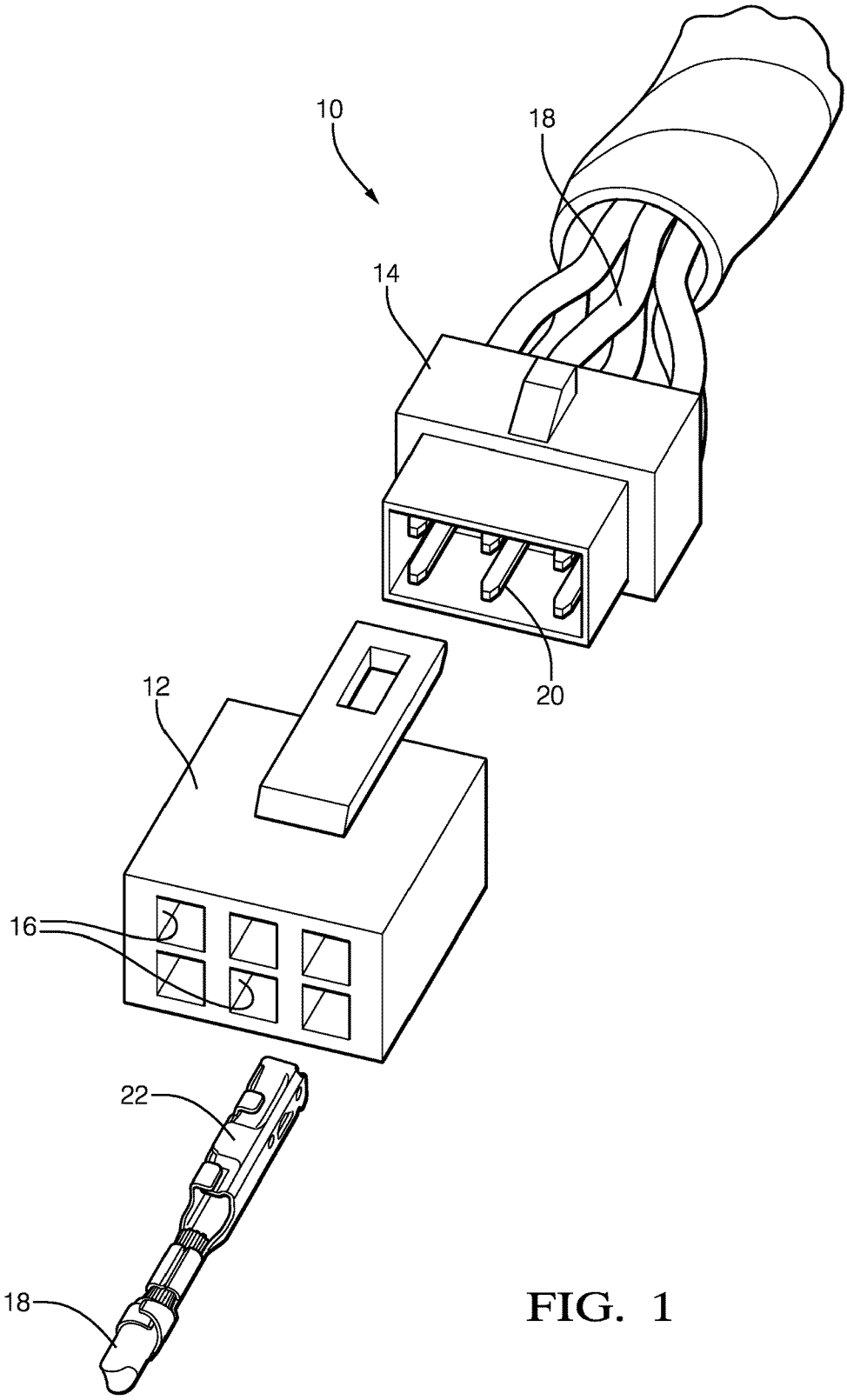
FIG. 1 is an exploded perspective view of an electrical connection system in accordance with one embodiment.

FIG. 1 illustrates a non-limiting example of an electrical connection system 10. The electrical connection system 10 includes a pair of molded dielectric connector housings 12, 14. A first connector housing 12 is a female connector housing 12 and a second connector housing 14 is a male connector housing 14 that mates with the female connector housing 12. The connector housings 12, 14 have a number of cavities 16 that are configured to retain an electrical terminal that is attached to an end of a wire cable 18. The male connector housing 14 contains a number of male blade or plug type terminals 20 while the female connector housing contains a number of female or socket terminals 22 configured to receive the male terminals. The female terminal 22 is a box-type female terminal having a resilient contact designed to apply a contact force between the male and female terminal 20, 22 in order to provide a reliable electrical connection therebetween. In this non-limiting example, the female terminal 22 is a dual contact beam terminal as described in U.S. Pat. No. 8,333,662 issued Dec. 18, 2012, the entire disclosure of which is hereby incorporated by reference.

Figure 2:
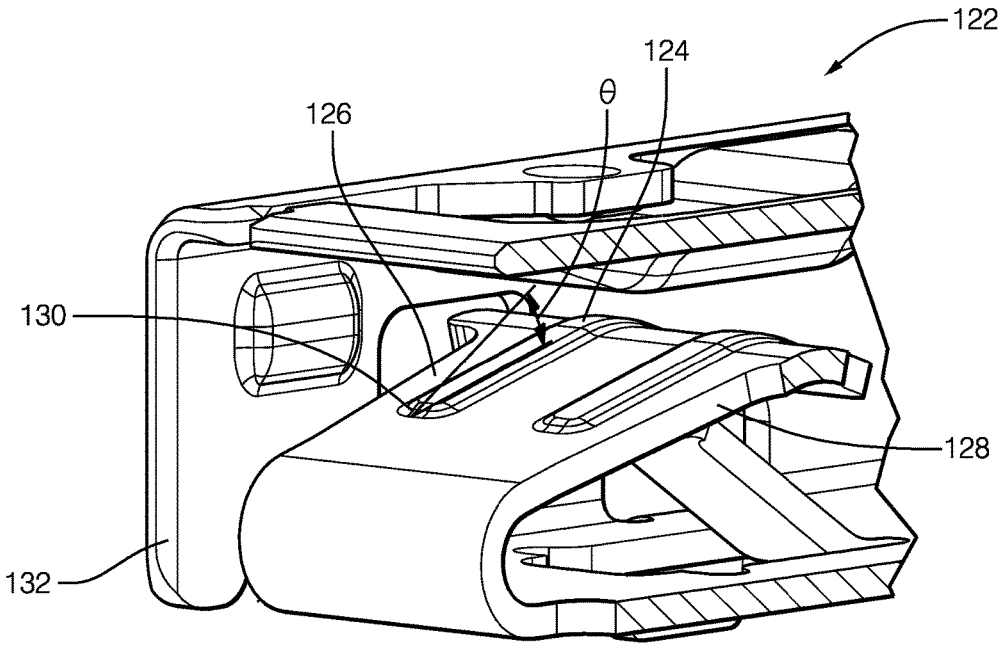
PRIOR ART FIG. 2
FIG. 2 is a perspective cut-away view of a female terminal according to the prior art.

FIG. 2 illustrates a prior art female terminal 122 having a pair of longitudinal protrusions 124 or contact ridges 124 that are formed in the top surface 126 of a resilient contact arm 128 by an embossing process. As can be seen in FIG. 2, a leading edge 130 of the contact ridges 124, i.e. the end of the contact ridge 124 closest to the terminal insertion end 132, is blunt. This blunt leading edge 130 forms an angle θ relative to the top surface 126 of the contact arm 128 that is greater than 45 degrees.

Figure 3:
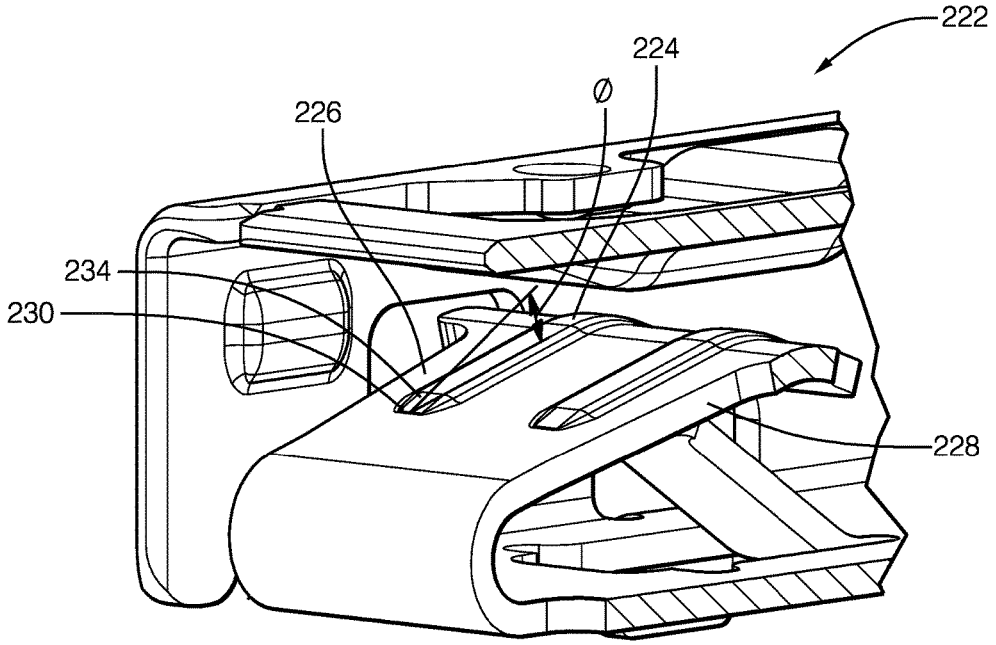
FIG. 3 is a perspective cut-away view of a female terminal of the electrical connection system shown in FIG. 1 in accordance with one embodiment.

FIG. 3 illustrates a non-limiting example of a female terminal 222 incorporating the inventive features. The illustrated example includes a pair of longitudinal protrusions 224 or contact ridges 224 that are formed in a top surface 226 of a resilient contact arm 228 by an embossing process. As can be seen in FIG. 3, a leading edge 230 of the contact ridge 224 forms ramp 234 that defines an angle Φ relative to the top surface 226 of the contact arm 228 that is greater than 0 degrees and less than or equal to 30 degrees. This contact ridge 224 is foamed by an embossing process using specially designed tooling to obtain the desired ramp angle Φ.

Figure 4:
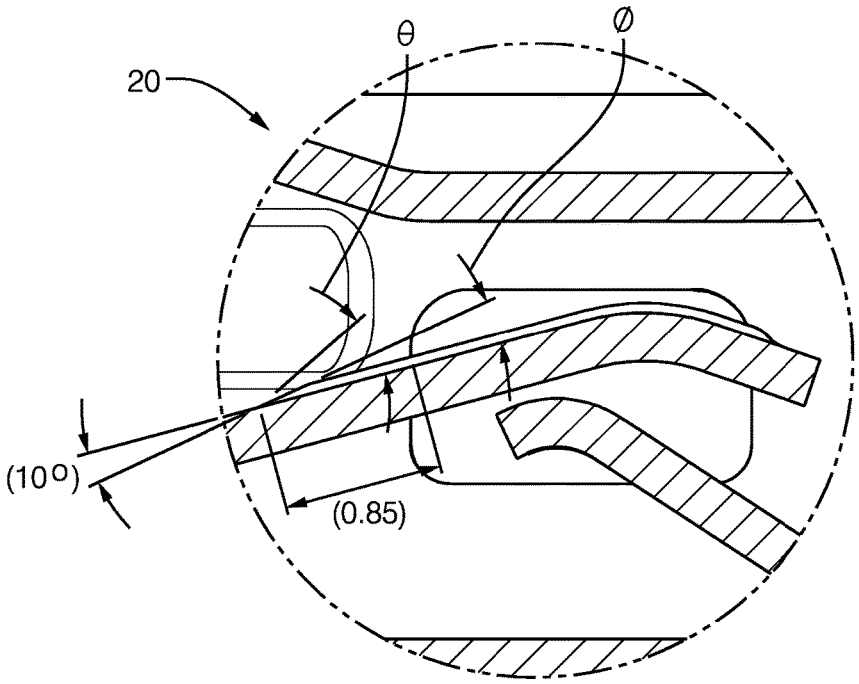
FIG. 4 is a cutaway side view of the female terminal of FIG. 3 superimposed over the female terminal of FIG. 2 shown as a dotted outline.

FIG. 4 illustrates a comparison of the leading edge 130 of the female terminal 122 shown in dotted outline versus the leading edge 230 of the female terminal 222 shown with a solid line. The ramp 234 in the illustrated example has an angle Φ of about 10 degrees. As used herein, about 10 degrees is in the range between 7.5 and 12.5 degrees. As can be seen, the ramp 234 on the leading edge 230 has a much less abrupt transition than the leading edge 130. As can be further seen in FIG. 4, the heights of the ridges at the apex of each of the contact arm 128, 228, i.e. the point at which the contact arm interfaces with the male terminal, is the same in both female terminals 122, 222. The female terminal 222 therefore provides the same final contact force as the female terminal 122.

Figure 5:
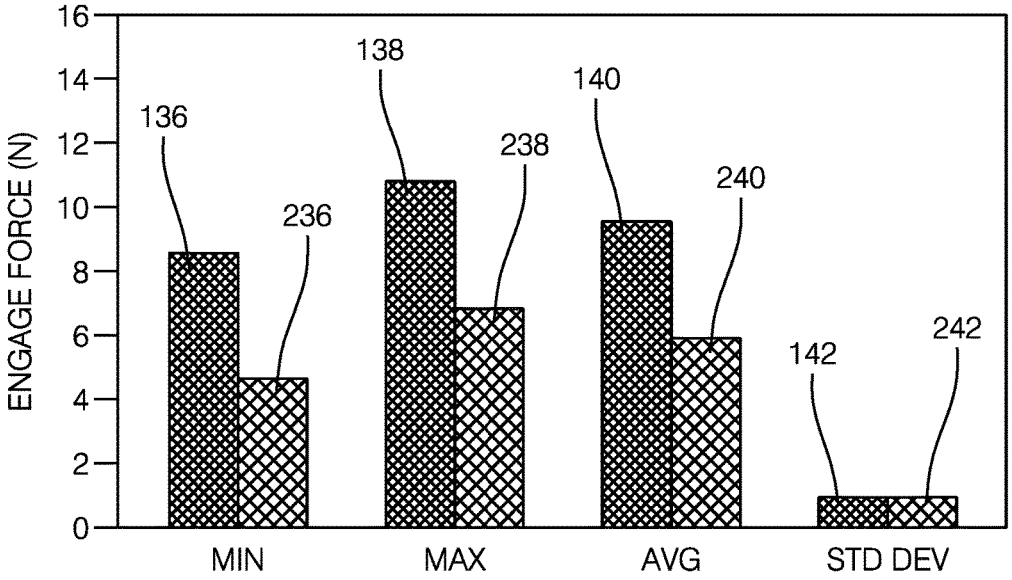
FIG. 5 is a graph comparing engagement forces of a connection system having the female terminal of FIG. 2 to an electrical connection system having the female terminal of FIG. 3.

FIG. 5 shows a comparison the test results of engagement for the female terminal 122 and the female terminal 222, wherein the female terminal 222 has a ramp angle Φ of about 10 degrees. As can be seen, the minimum 236, maximum 238, and average 240 peak engagement force of female terminal 222 is reduced by about 37% compared to the minimum 136, maximum 138, and average 140 peak engagement force of female terminal 222 while maintaining the same standard deviation 242, 142 and while still providing the same final contact force.

While the illustrated embodiments include a pair of contacts ridges, alternative embodiments may be envisioned having a single contact ridge or more than two contact ridges. While the ramp in the illustrated example is formed during the embossing process, embodiments using other methods to form the ramp, such as grinding or material deposition. The ramp on the leading edge may also be applied to other terminal designs, including male bladed terminals in order to reduce peak engagement force.

Accordingly, an electrical connection system 10 having a female terminal 222 is provided. The ramps 234 formed on the leading edges of the contact ridges 224 of the female terminal 222 provide the benefit of a point contact between the male terminal and the female terminal 222 while reducing the peak engagement force 236, 238, 240 experienced by an operator when mating the female and male terminals.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

I claim:

1. An electrical connection system, comprising:

a male terminal; and a female terminal configured to receive the male terminal, wherein the female terminal has a resilient contact defining a plurality of ridges extending vertically from the resilient contact and longitudinally along the resilient contact, wherein said plurality of ridges is configured to provide contact points between the female terminal and the male terminal, and wherein a leading edge of each of the plurality of ridges forms an angle with the resilient contact that is greater than 0 degrees and less than or equal to 30 degrees.

2. The electrical connection system according to claim 1, wherein the leading edge is substantially linear.

3. The electrical connection system according to claim 2, wherein the angle is about 10 degrees.

4. The electrical connection system according to claim 3, wherein the plurality of ridges is formed by embossing the resilient contact.

5. The electrical connection system according to claim 4, wherein the resilient contact is characterized as a cantilever beam.

6. The electrical connection system according to claim 5, wherein the resilient contact has an arcuate shape that defines an apex and wherein the plurality of ridges extends over the apex.

7. A female electrical socket terminal configured to receive a corresponding male plug terminal, comprising:

a resilient contact configured to contact the male plug terminal; and a plurality of longitudinal protrusions projecting from a top surface of the resilient contact, wherein said longitudinal protrusion is configured to provide a point contact between the resilient contact and the male plug terminal and wherein a leading edge of each of the plurality of longitudinal protrusions forms a ramp on a forward edge of the longitudinal protrusion, said ramp having a second top surface that forms an angle relative to the first top surface that is greater than 0 degrees and less than or equal to 30 degrees.

8. The female electrical socket terminal according to claim 7, wherein the resilient contact is characterized as a cantilever beam.

9. The female electrical socket terminal according to claim 8, wherein the resilient contact has an arcuate shape that defines an apex and wherein the plurality of longitudinal protrusions extends over the apex.

10. The female electrical socket terminal according to claim 7, wherein the ramp is substantially linear.

11. The female electrical socket terminal according to claim 10, wherein the angle is about 10 degrees.

12. The female electrical socket terminal according to claim 11, wherein the plurality of longitudinal protrusions is formed in the resilient contact by an embossing process.

* * * * *